US009447506B2

(12) United States Patent
Whitmore

(10) Patent No.: US 9,447,506 B2
(45) Date of Patent: Sep. 20, 2016

(54) CATHODIC PROTECTION OF A CONCRETE STRUCTURE

(76) Inventor: David Whitmore, Winnipeg (CA)

( * ) Notice: Subject to any disclaimer, the term of this patent is extended or adjusted under 35 U.S.C. 154(b) by 0 days.

(21) Appl. No.: 13/561,714

(22) Filed: Jul. 30, 2012

(65) Prior Publication Data

US 2014/0027306 A1 Jan. 30, 2014

(51) Int. Cl.

| | |
|---|---|
| ***C23F 13/00*** | (2006.01) |
| ***C23F 13/06*** | (2006.01) |
| ***C23F 13/18*** | (2006.01) |
| ***C23F 13/10*** | (2006.01) |
| *E02B 17/00* | (2006.01) |
| *E01D 22/00* | (2006.01) |

(52) U.S. Cl.

CPC ..... *C23F 13/06* (2013.01); *C23F 13/10* (2013.01); *C23F 13/18* (2013.01); *C23F 2201/02* (2013.01); *C23F 2213/22* (2013.01); *C23F 2213/31* (2013.01); *E01D 22/00* (2013.01); *E02B 17/0026* (2013.01)

(58) Field of Classification Search

CPC ..... C23F 13/00; C23F 13/02; C23F 13/06; C23F 13/08; C23F 13/18; C23F 13/20; C23F 13/16; C23F 2201/02; C23F 13/10; C23F 2213/22

USPC ..... 205/734, 724, 704, 687, 731, 740; 204/196.01, 196.3, 196.37, 196.36

See application file for complete search history.

(56) References Cited

U.S. PATENT DOCUMENTS

| | | | | |
|---|---|---|---|---|
| 4,692,066 A | | 9/1987 | Clear | |
| 5,296,120 A | * | 3/1994 | Bennett et al. | 204/196.33 |
| 5,714,045 A | * | 2/1998 | Lasa et al. | 204/196.18 |
| 5,968,339 A | * | 10/1999 | Clear | 205/730 |
| 6,217,742 B1 | * | 4/2001 | Bennett | 205/734 |
| 6,346,188 B1 | * | 2/2002 | Shuster et al. | 205/734 |
| 7,338,591 B2 | * | 3/2008 | Vælitalo | 205/734 |
| 7,520,974 B2 | * | 4/2009 | Whitmore | 205/734 |
| 2005/0090789 A1 | * | 4/2005 | Graef et al. | 604/368 |
| 2010/0147703 A1 | * | 6/2010 | Glass | C23F 13/06 205/732 |

FOREIGN PATENT DOCUMENTS

GB 2194962 A * 3/1988 ..... C23F 13/02

OTHER PUBLICATIONS

Saeid Kakooei, Hazizan Md Akil, Abolghasem Dolati, Jalal Rouhi, "The corrosion investigation of rebar embedded in the fibers reinforced concrete", May 27, 2012, Construction and Building Materials 35, 564-570.*

Wang et al. (Journal of Wuhan University of Technology-Material Science Education, vol. 22, No. 1, 2007, pp. 108-111).*

Kakooei et al (Construction and Building Materials, 35 (2012), p. 564-570).*

Grainger (Green/Yellow, Cellulose/Synthetic Fiber Scrubber Sponge, Length 6", Width 3-5/8", 20 PK, date unknown).*

* cited by examiner

*Primary Examiner* — Luan Van
*Assistant Examiner* — Alexander W Keeling
(74) *Attorney, Agent, or Firm* — Adrian D. Battison; Ade & Company Inc

(57) ABSTRACT

Corrosion of steel in a concrete structure such as a column in sea water occurs primarily above the water line and is inhibited using cathodic protection by attaching to the column an impervious sealed sleeve in which is provided a sacrificial anode in sheet form in contact with a layer of water transport medium so that water from the location of the bottom of the water transport medium within the water is carried into the area of the sacrificial anode to enhance ionic current.

32 Claims, 5 Drawing Sheets

CATHODIC PROTECTION OF A CONCRETE STRUCTURE

This invention relates to a method of cathodic protection of a concrete structure having a part in contact with a wetting medium and a part above the medium, such as a column within a salt water environment.

Normally the concrete structure would extend down below the water level but there are structures like some bridges where the concrete is poured on top of steel pilings such that the concrete section may be above the water line some or all of the time.

BACKGROUND OF THE INVENTION

Concrete structures such as columns in salt water tend to corrode at the location above the salt water in the inter-tidal zone where the column is subject to wetting and drying and in the splash zone and above where the concrete is occasionally exposed to salt water.

One solution to this problem is to surround the column with a jacket containing a layer of grout within which is buried or located a sacrificial anode as a mesh or layer surrounding the column. This anode is electrically connected to the steel in the column to set up an electric current through the connection and an ionic current through the electrolyte and the concrete from the anode to the steel to tend to inhibit the corrosion of steel in favour of the corrosion of the sacrificial anode.

A recent example of an arrangement of this type is shown in U.S. Pat. No. 7,520,974 issued Apr. 21, 2009 by the present Applicant. Further examples are shown in prior U.S. Pat. No. 5,714,045 (Lasa) assigned to Alltrista Corporation and issued Feb. 3, 1998 and in U.S. Pat. No. 4,692,066 (Clear) issued Sep. 8, 1987.

The present Applicant in U.S. Pat. No. 7,520,974 issued Apr. 21, 2009 discloses a modified arrangement in which an impervious sealed sleeve is provided which carries no anode itself but which cooperates with an anode body in the water below the sleeve. The sleeve acts to inhibit permeation of oxygen through the concrete to the steel and at the same time acts to promote transfer of current from the anode through the concrete under the sleeve by preventing drying by preventing moisture escape. An anode arrangement may be provided only at the top of the sleeve to consume oxygen in that area. The sleeve may be applied over a layer of grout. The top edge surface of the grout may be sealed from the sleeve to the column.

The disclosures of each of the above documents are incorporated herein by reference.

It is also known to simply clamp an anode onto the column below water level to protect the portion of the column within the water. As the salt water is highly conductive, most of the current generated is transferred to steel in the wet portion of the column and little of the current generated in the galvanic action is transferred to the area of most corrosion which is the area at and above the water line which is wetted and dried. This problem is discussed in the above patent of Clear.

In some cases, as shown for example in Lasa above, the above jacket and anode arrangement is used with a below water additional anode, commonly known as a bulk anode, so as to avoid the lower part of the mesh anode in the jacket which is mostly or wholly below water from being rapidly corroded and lost.

In other cases, for a simple inexpensive repair with no cathodic protection, a simple wrapping is applied around the column at the water line so as to cover up and hide the worst of the damage. This arrangement may provide a physical barrier but of course does not provide any cathodic protection by galvanic action so that the underlying corrosion continues. As discussed in Lasa above, this type of repair is considered to be merely cosmetic, merely acting to cover up the worst of the cracking and exposed steel. However this can provide a cheap fix with short life span of protection. The wrapping can surround a layer of grout which covers the worst of the cracking and repairs any holes or the wrapping can be applied directly to the column. In some cases the wrapping is filled with a non-cementitious material such as epoxy.

SUMMARY OF THE INVENTION

It is one object of the present invention to provide a method of cathodic protection of a concrete structure where a first part of the concrete structure is in contact with an ionically conductive material which contains water, and a second part of the concrete structure, continuous with the first part, is spaced above the ionically conductive material, the concrete structure having steel reinforcement at least in the second part.

According to a first aspect of the invention there is provided a method of cathodic protection of a concrete structure where at least a part of the concrete structure is spaced above an ionically conductive material which contains water, the concrete structure having steel reinforcement at least in the part above the material;

the method comprising:

providing a sacrificial anode which is more electronegative than steel in contact with at least a portion of the concrete structure;

providing an electrical connection from the sacrificial anode to the steel in the concrete so that current flows through the electrical connection between the sacrificial anode and the steel and an ionic current flows through the concrete between the anode and the steel to cause the sacrificial anode to corrode preferentially to the steel;

and providing a water transport medium extending from the material to a position above the material.

This water transport medium can provide additional wetting with the water of at least parts of the concrete above the material.

In most cases the sacrificial anode includes at least a part located above the material and the water transport medium is at least partly in contact with or adjacent to the sacrificial anode. However the present arrangement also can operate to provide additional wetting of the concrete and provide an improved ionic path in an arrangement as set out in the above U.S. Pat. No. 7,520,974 where the sacrificial anode is wholly below the area of the concrete to be protected.

Many different arrangements of the water transport medium can be used, provided the medium acts to carry additional water from the water available in the material below the area of concrete being protected to the part of the concrete to be protected and to the sacrificial anode in that area. That is the medium carries additional water to that which would be present in the concrete structure itself or under a jacket of the type shown in the above patents. The medium when in contact with water and particularly when in contact with salt water also provides an improved ionic path for ionic current to flow along the medium and to flow from the sacrificial anode to the medium and from the medium into the surrounding concrete. This allows current to flow to regions which would normally be too dry and non-conductive to receive sufficient current from a sacrificial anode.

Thus the water transport medium may have one or more of the following characteristics:

It forms a layer which can cover an area of the concrete and/or be in contact with the sacrificial anode so as to carry the additional water over an area of those components.

It can comprise organic or inorganic fibers which carry water between or within individual fibers, such as fibers of glass, basalt, bamboo, cellulose, polyester or polypropylene.

It can comprise a material providing open interconnected pores, such as open cell cellulose or polyurethane foam or cellulose or glass fiber matting. Individual fibers, flakes or other material components do not need to be continuous but the resulting pores need to be open and preferably interconnected.

Preferably the material has a good wetting ability, low surface tension when in contact with water and produces a low contact angle if measured on a flat surface.

Preferably the material is in contact with the embedded anode and preferably the wicking material provides continuous pores, capillaries or paths for water migration. Preferably the pores are open and interconnected such that water can be transported a significant distance easily without the need to diffuse through solid material as this greatly reduces the ability of water to migrate and the effective distance it can travel. Also the wicking material is preferably non-alkaline such that the wicking material does not interfere with the ability of an embedded zinc anode to be able to corrode and thereby provide corrosion protection to the reinforcing steel.

It can act by wicking or capillary action to raise the water through the medium. This is the ability of a liquid to flow in narrow spaces without the assistance of, and in opposition to external forces like gravity. The effect can be seen in the drawing up of liquids between the hairs of a paint-brush, in a thin tube, in porous materials such as paper, or in a cell. It occurs because of inter-molecular attractive forces between the liquid and solid surrounding surfaces. If the diameter of the tube is sufficiently small, then the combination of surface tension (which is caused by cohesion within the liquid) and adhesive forces between the liquid and container act to lift the liquid.

The water transport medium has characteristics so that it provides a significantly greater level of moisture transfer than does the grout or concrete layer itself. This can be determined by the fact that although concrete or grout has pores, most of the pores are not interconnected such that concrete acts as a good waterproofing layer and does not readily support the flow of water. Concrete and cement grout is also alkaline and at the typical pH of these materials they have a tendency to minimize corrosion of embedded zinc. Field studies performed by government agencies have documented the limited ability of concrete or grout to be able to maintain the corrosion of the embedded sacrificial anode any significant distance above the water level. Protection diminishes quickly above the water level when a zinc mesh anode is embedded or in direct contact with concrete or grout such that sufficient corrosion protection is not provided. Also the fact that the additional water transport medium is located directly in contact with the sacrificial anode ensures that the additional moisture is carried to the position where it has most effect on the ionic current from the sacrificial anode.

The water absorption medium can act by water absorption. Water absorbent materials and super absorbent polymers such as sodium polyacrylate and cross linked carboxymethylcellulose can be beneficial in absorbing water and providing additional water to locations above the water line.

It can include hollow fibers at least some of which are oriented to extend generally upwardly.

The water transport medium can be located within the concrete structure, on an outside surface of the concrete structure or in an additional covering layer applied onto the concrete structure.

Preferably the sacrificial anode extends along the concrete structure to a top of the anode at a top of an area of the concrete structure to be protected and preferably the water transport medium extends at least to the top of the sacrificial anode. Preferably it extends beyond the top where it is exposed to air for evaporation of water from the top.

Preferably the water transport medium is wholly or partly covered by a covering layer over the concrete structure which covers at least part of the water transport medium and the sacrificial anode. The covering layer may include a water and/or oxygen impermeable material which may form an impermeable layer.

In this case the water transport medium generally includes a portion thereof at a position below the covering layer for engaging the material.

Where a covering layer is provided, the covering layer can cover a layer of grout applied over a surface of the concrete structure or can be applied directly to an outer surface of the concrete structure. Where the covering layer is used, the covering layer, the water transport medium and the sacrificial anode are preferably all formed as part of a common structure applied onto the exterior of the concrete. The common structure may act as a form for a layer of grout to be cast onto the surface of the concrete or it may be applied directly to the concrete surface.

Preferably the sacrificial anode comprises an anode sheet which may be a mesh material or other form of solid or perforated material for covering at least part of the concrete structure. The water transport medium comprises a layer in contact with or adjacent to the sheet and may cover one or both sides of the anode sheet. Alternatively, the anode may be in the form of one or more rods or strips and the water transport medium may extend along the length or surround the anode rods or strips.

Preferably there is provided at least one activator at or adjacent the sacrificial anode to promote corrosion of the anode. The activator can be of any type well known in this field.

According to a second aspect of the invention there is provided an apparatus for cathodic protection of a concrete structure where at least a portion of the concrete structure is spaced above an ionically conductive material which contains water, the concrete structure having steel reinforcement at least in the part above the material;

the apparatus comprising:

a sacrificial anode formed of a material more electronegative than steel arranged for placement in ionic contact with the concrete;

and a water transport medium arranged for placement at or adjacent the sacrificial anode;

the sacrificial anode and the water transport medium comprising an assembled structure for common application to the concrete structure;

the assembled structure being arranged such that the sacrificial anode when applied to the concrete structure is in ionic contact with at least a part of the concrete structure above the material and the water transport medium extends from the material to said at least a part of the sacrificial anode.

According to a third aspect of the invention there is provided an apparatus for cathodic protection of a concrete structure where at least a portion of the concrete structure, is spaced above an ionically conductive material which contains water, the concrete structure having steel reinforcement at least in the part above the material;

the apparatus comprising:

a covering layer for covering at least a part of the concrete structure;

a sacrificial anode formed of a material more electronegative than steel arranged for placement in ionic contact with the concrete;

and a water transport medium arranged for placement at or adjacent the sacrificial anode;

the covering layer, sacrificial anode and the water transport medium comprising an assembled structure for common application to the concrete structure with the covering layer covering the sacrificial anode and the water transport medium;

the assembled structure being arranged such that the sacrificial anode when applied to the concrete structure is in ionic contact with at least a part of the concrete structure above the material and the water transport medium extends from the material to said at least a part of the sacrificial anode.

BRIEF DESCRIPTION OF THE DRAWINGS

One embodiment of the invention will now be described in conjunction with the accompanying drawings in which:

FIG. 6 is a longitudinal cross sectional view identical to that of Fig. 3 But modified to show an arrangement in which the layer of the water transport medium Covers both sides of anode sheet.

DETAILED DESCRIPTION

Figure 1:
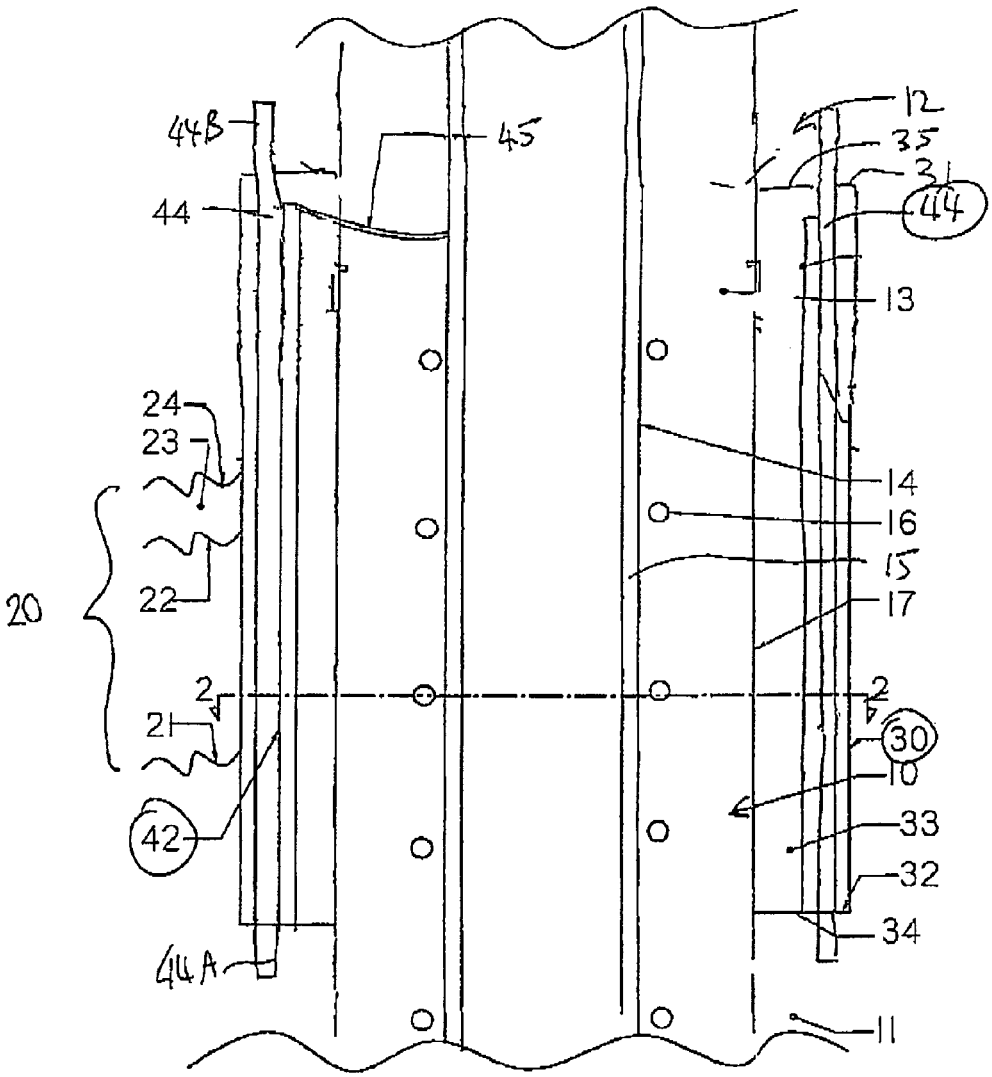
FIG. 1 is a longitudinal cross sectional view through a column including the application to the column of a first embodiment method of corrosion protection according to the present invention.

In FIG. 1 is shown a conventional reinforced concrete column mounted in water so that the column 10 has a bottom end generally indicated at 11 mounted on a suitable support in the water with the upper end 12 arranged to carry a structure to be supported by the column. Typical columns of this type are formed of a concrete body 13 within which are steel reinforcing members generally indicated at 14. These include vertical longitudinal members 15 and transverse or peripheral hoops or ties 16. The steel reinforcement is located inside the column just under the outside surface 17 of the column.

The column is illustrated as being mounted so that a part of the length of the column is located in the inter-tidal zone generally indicated at 20 with a low tide mark indicated at 21 and a high tide mark indicated at 22. Above the high tide mark is a splash zone 23 with an upper location 24. It will of course be appreciated that the tides vary and the amount of splash height varies but in general the area between the low tide mark 21 and the top of the splash zone 24 provides an area of the column which is subject to repeated wetting and drying depending upon the height of the water surrounding the column at any time.

This zone and the area extending upwards from this zone of the concrete column is particularly subject to corrosion since the steel is exposed to moisture, chlorides and oxygen which act to break down the steel and form corrosion products. These corrosion products may cause expansion sufficient to crack the concrete. In addition to this cracking, the corrosion of the steel may also result in loss of structural capacity.

The technique of the present invention is primarily intended as a repair technique for the column but it can also be used in new constructions.

Figure 2:
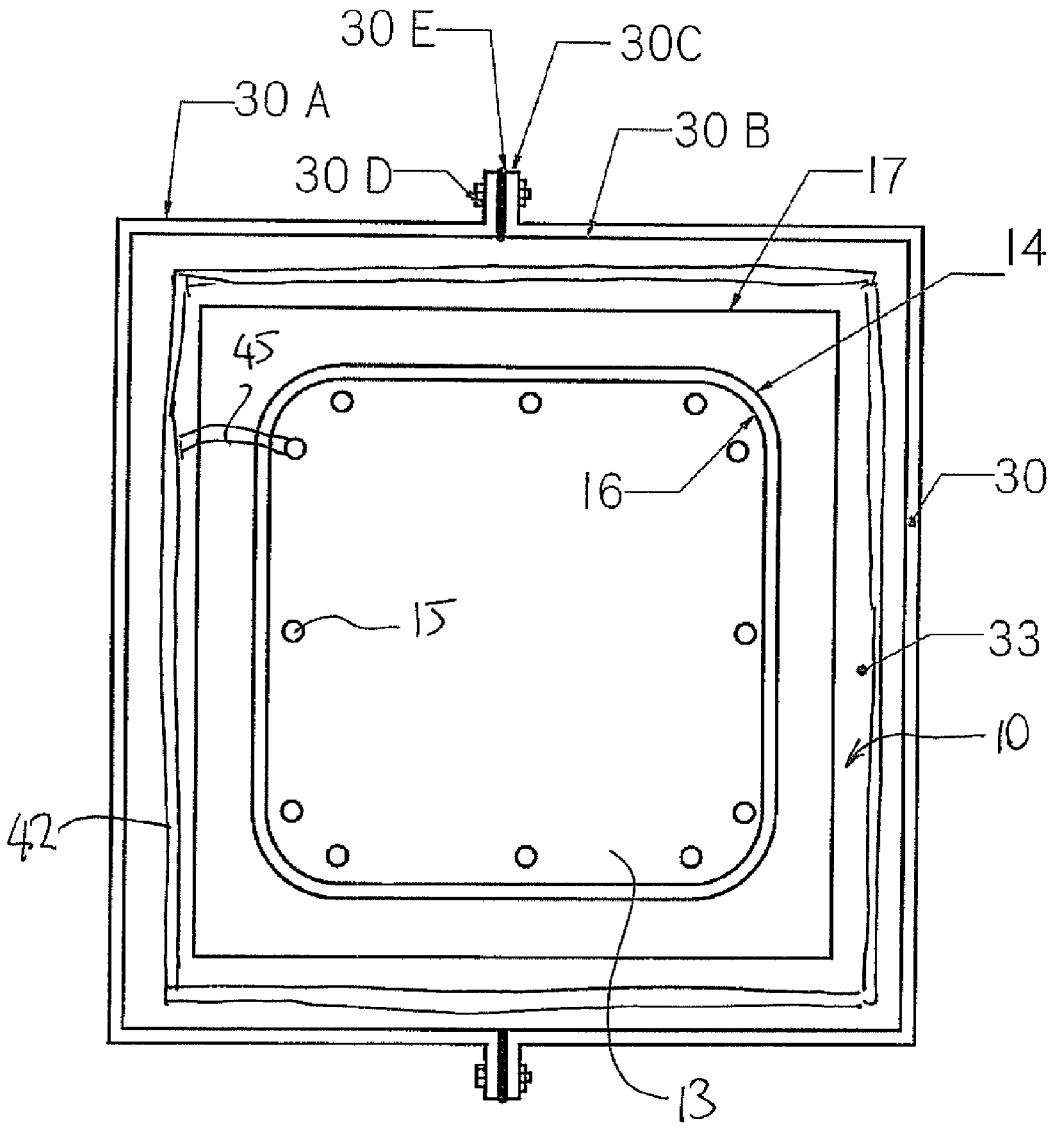
FIG. 2 is a cross section along the lines 2-2 of FIG. 1.

The construction of the present method comprises a surrounding impermeable layer or jacket 30 which is attached to the column at a position outward of the outer surface 17 of the column. The jacket 30 may be formed of an impermeable material such as resin or stainless steel. The jacket may be reinforced to provide structural strength to assist resisting movement of the concrete or the jacket may be fabric, or a stretchable or flexible material without such structural reinforcement so that it simply moves with any movement of the concrete. Where reinforced, it may be reinforced by fibres such as glass, plastics, carbon fibers or other materials well known to a person skilled in the art. In the embodiment as shown in FIG. 2, the impermeable layer or jacket 30 is formed in pieces 30A and 30B which are connected at a joint 30C. In the embodiment shown the joint is a butting flange joint where two projecting flanges of the two parts of the jacket butt and are clamped together by bolts 30D with a layer of a sealing material 30E between the two butting flanges. This ensures that the jacket is fully sealed around the column at the connections between the parts of the jacket to form a sealed sleeve around the column from a top edge 31 of the jacket to a bottom edge 32 of the jacket. Other methods of sealing the joints are also possible such as tongue and groove joints and lap splice joints.

Inside the jacket is filled with a cementitious or polymer grout or other filler material 33 to form a band of the material around the column within the jacket. In most cases the jacket is used as a form for applying the grout to the column. Prior to application, repairs can be made to any cracked portions by excavation or removal of damaged concrete materials so that the finished jacket is filled with material surrounding the column and filling any indentations, cracks or excavated portions of the concrete column. The grout is commonly Portland cement based which cures and bonds to the outside surface of the column and acts as an effective filler material. Other types of filler materials including other organic and inorganic based materials may be used.

During filling of the jacket, the bottom edge 32 of the jacket may be closed by a forming structure to hold the grout material in place until it is set. After the setting of the grout, the bottom form is preferably removed so that the bottom surface 34 of the grout is exposed. However it may also be left in place. At the top 31 of the jacket, after filling, an upper surface 35 of the grout is generally exposed.

The anode for the cathodic protection system comprises a sheet anode 42 surrounding the column under the jacket 30. The anode 42 is connected to the reinforcing steel by an electrical conductor or wire 45 which is connected to the steel reinforcement within the column. If necessary, additional connections can be provided to other parts of the reinforcing steel depending upon the electrical continuity of the steel reinforcement bars.

Thus the cathodic protection system includes an anode 42 provided by the sacrificial anode material, the reinforcing steel 14, an electrical connection 45 from the anode to the steel and an ionic connection from the anode through ionically conductive material which may include the grout and the concrete to the steel to provide cathodic protection of the steel while effecting sacrificial corrosion of the anode.

The sacrificial anode is provided as a sheet or layer extending fully around the column adjacent the outer surface of the concrete so that ionic current passes through the grout layer to the concrete. The sacrificial anode is preferably and typically formed as a zinc mesh of expanded metal or other perforated sheet. Alternatively, the sacrificial anode may be provided in the form of a solid sheet or as rods, strips or discrete pieces. The water transport medium may be provided in the form of a layer or layers, a sock, a bag or provided in strips to be installed adjacent to the sacrificial anode. A suitable known enhancement material may be provided at the anode as part of its structure or in a next adjacent layer such as the grout.

In addition to the concrete, the grout and the anode within the jacket 30 is provided a layer 44 of a water transport medium. This is located adjacent to the sacrificial anode layer and preferably extends from a position below the water line 21 so as to be in contact with the water to a position above the water line. As shown therefore the layer 44 extends from a bottom portion 44A exposed beyond the bottom of the jacket to a top portion 44B exposed above the top of the jacket. This layer acts to provide additional wetting with the water from below the water line of the structure at least at parts of the concrete above the water line so as to provide additional water in the grout, at the sacrificial anode and inside the jacket to enhance the creation of the ionic current.

The water transport medium also acts to provide an improved, low resistance, ionic path between the sacrificial anode and the steel. In situations where the water transport medium is exposed to salt water, the improvement in ionic conduction is further improved. The resistance through the concrete between the sacrificial anode and the steel is reduced and the current is increased. As a result, steel which is close to the anode is better protected and sufficient current to protect the steel is able to travel a greater distance such that the protected area is increased.

The sacrificial anode forms the sheet inside the jacket so that this also includes at least a part located above the water line and part below the water line. As set out above, the layer 44 of the water transport medium is at least partly in contact with or adjacent to the sacrificial anode. Thus as shown the layer of water transport medium is located at least on one side or face of the sacrificial anode and possibly both inside and outside the sacrificial anode within the jacket.

The portion 44A below the jacket has direct access to the water so as to cause it to enter the layer for transport along the column to the top of the jacket. The portion 44B above the jacket allows evaporation to occur which increases the transfer of water through the layer.

In order to provide an efficient manner of assembly of the construction for operation of the method above, the sacrificial anode and the water transport medium form an assembled structure for common application to the concrete structure. That is the two layers can be supplied together as a wrapping to engage around the column or otherwise to be applied to the surface of the concrete.

More preferably the covering layer, sacrificial anode and the water transport medium all form an assembled structure for common application as an assembled structure on to the concrete structure with the covering layer covering the sacrificial anode and the water transport medium. Thus the outer jacket 30 has the sacrificial anode and the water transport medium formed as layers inside the outer jacket. In this way this structure can be simply applied onto the column as a tight wrapping or as a form for grout to be poured into the jacket.

The water transport medium comprises the characteristics set forth above.

The impermeable sleeve 30 around the steel within the jacket prevents escape of moisture from the jacket during the time that the concrete is exposed to the air and thus is otherwise free to dry.

As an alternative, the jacket can be formed as a single part which is wrapped around the column and a single overlap seal can be provided.

Figure 3:
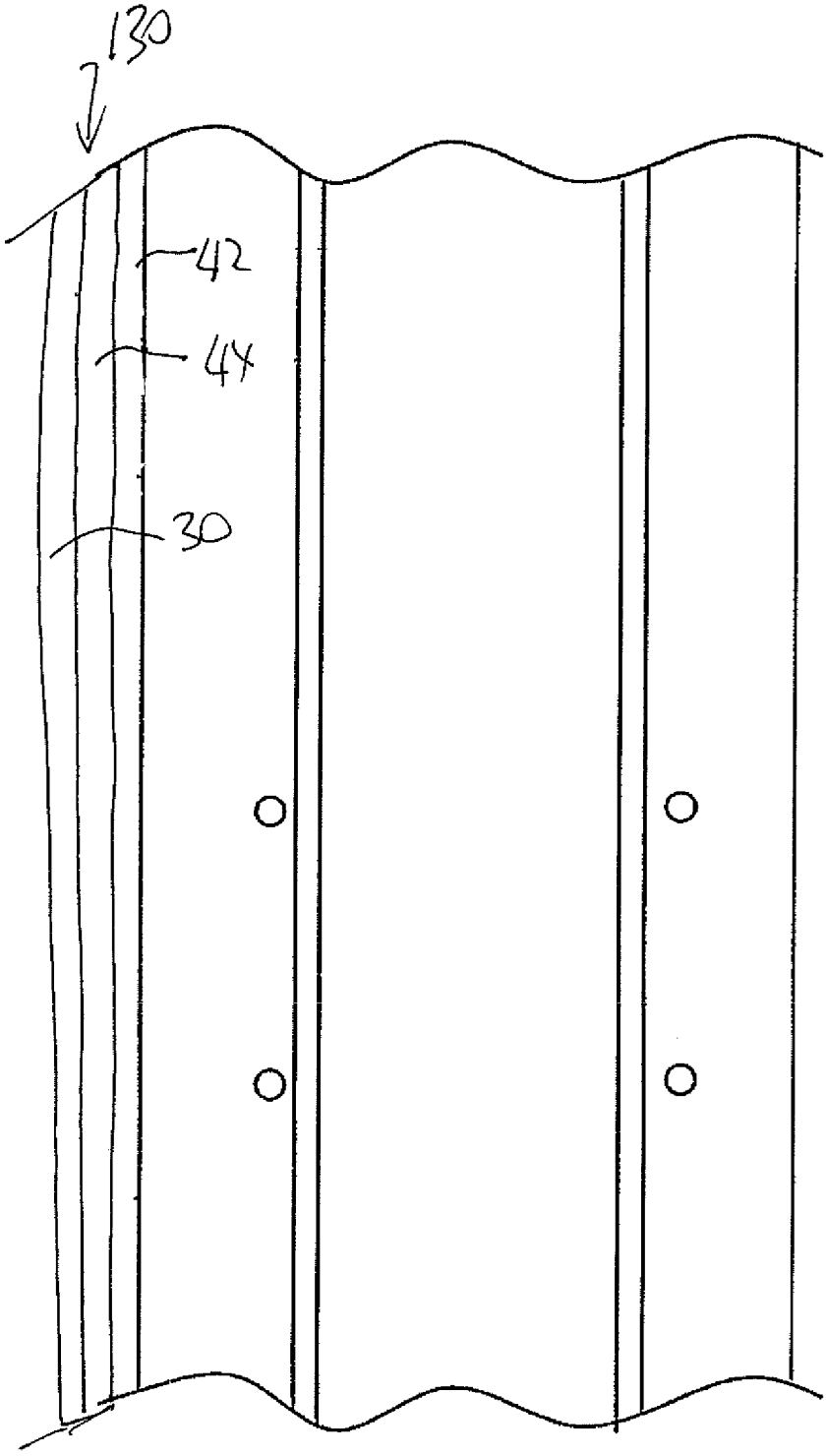
FIG. 3 is a longitudinal cross sectional view through a column including the application to the column of a second method of corrosion protection according to the present invention where the jacket, sacrificial anode and water transport medium are directly applied to the column.

In FIG. 3 is shown a further alternative arrangement in which the jacket 30 is replaced by a jacket 130 which is wrapped around the column and applied directly to the outside surface of the concrete. In this arrangement, therefore, there is provided no additional grout apart from possibly grout provided to fill cracks or holes within the concrete of the column. The intention is therefore that a simple sleeve is wrapped around the column in the inter-tidal and splash zone. If there is no necessity for repair, the jacket 130 is applied directly onto the column without any grout at all. In this arrangement the jacket can be provided by a fibreglass lay-up process formed on site simply by applying or wrapping fiber glass sheet material and a resin onto the outside surface of the column.

Other suitable plastic, rubber, organic or inorganic materials can be used as the sheet.

This arrangement therefore provides a very simple construction formed on site at relatively low cost by providing simply the wrapping 130 forming the jacket containing the sacrificial anode 42 and the water transport medium 44.

Figure 4:
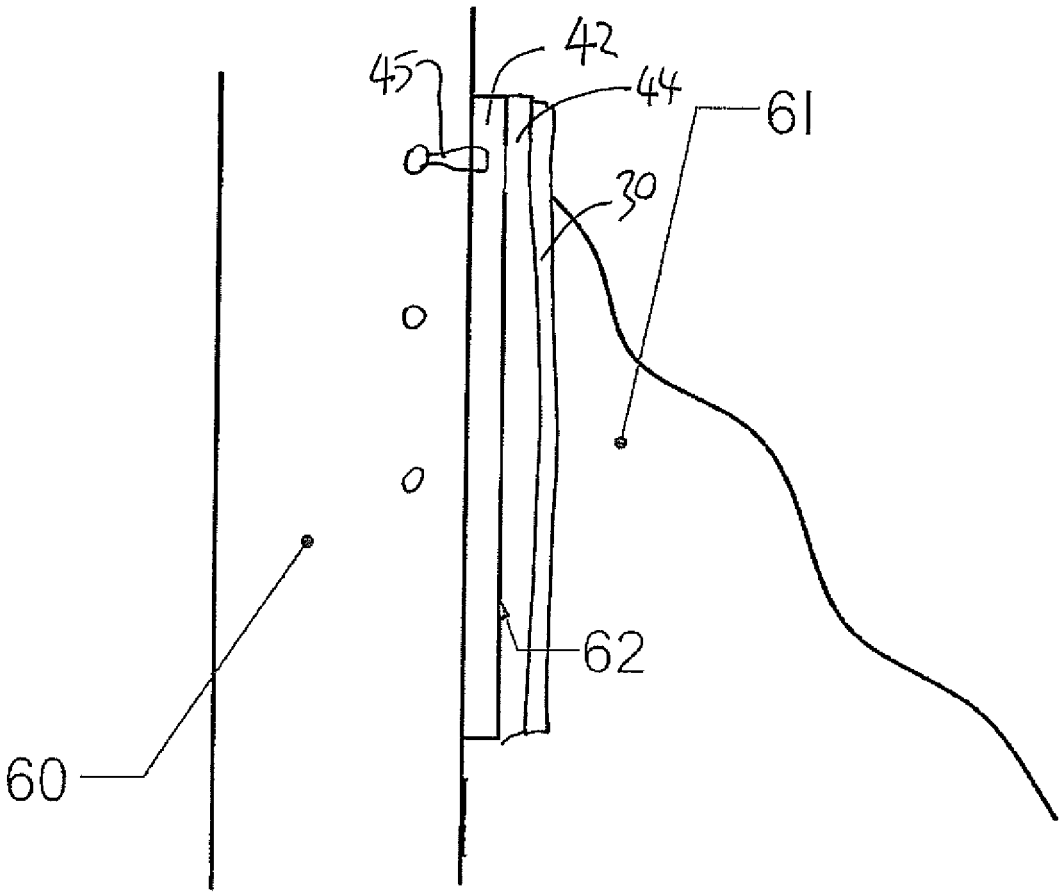
FIG. 4 is a longitudinal cross sectional view through a structure showing a method of corrosion protection according to the present invention where the jacket, sacrificial anode and water transport medium are directly applied to a surface of a structure.

In FIG. 4 is shown the application of the above techniques to an upstanding wall 60 which acts to brace fill material 61 on one side of wall, for example in a bridge structure where the wall forms a support for the end of the bridge beams. The wall therefore may have a width equal to the width of the bridge. The medium 61 can simply be wet soil or it may be that the wall is formed also in sea water which therefore contacts one or both surfaces of the wall. However in this arrangement a layer 62 is applied onto one surface of the wall in the manner as described above in relation to FIG. 1 or FIG. 4 so layer 62 includes the covering 30, the water transport medium 44 and the sacrificial anode 42 connected to the reinforcing steel. In some cases the layer 62 is provided on only one surface of the structure and other embodiments may be provided on both surfaces of the structure, depending upon the location of the medium 61 and the presence of the corrosion problem.

Figure 5:
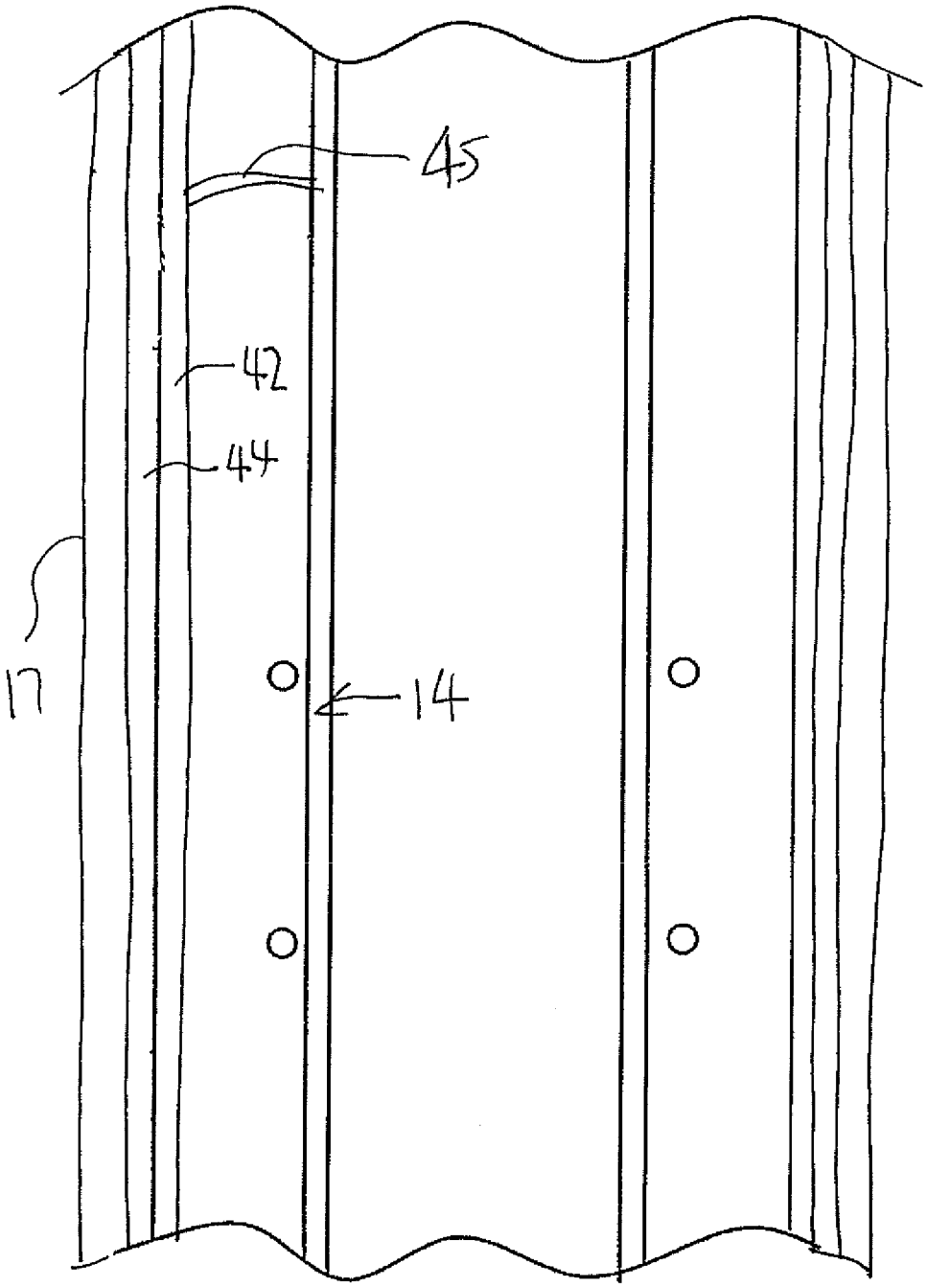
FIG. 5 is a longitudinal cross sectional view through a column including the application to the column of a third method of corrosion protection according to the present invention where the sacrificial anode and water transport medium are located within the column.

In FIG. 5 is shown a further embodiment in which the water transport medium 44 is located adjacent the sacrificial anode 42 within the concrete structure itself. This arrangement is therefore typically formed in a new structure where the layers 42 and 44 are applied into the column as it is being cast.

In FIG. 6 is shown a longitudinal cross sectional view identical to that Of FIG.3 showing an arrangement in which the layer shown at 44 and 44C of the Water transport medium covers both sides of the anode sheet 42.

The invention claimed is:

1. A method of cathodic protection of a concrete structure comprising steel reinforcement in concrete located in sea water where at least a part of the concrete structure is located above a level of the sea water and part is below the level of the sea water, the method comprising:

providing a sacrificial anode construction which is more electro-negative than the steel reinforcement wherein the sacrificial anode is in ionic contact with at least a portion of the concrete;

the sacrificial anode construction including at least a part above the level of the sea water;

providing an electrical connection from the sacrificial anode construction to the steel reinforcement in the concrete so that current flows through the electrical connection between the sacrificial anode construction and the steel reinforcement and an ionic current flows through the concrete between the anode and the steel reinforcement to cause the sacrificial anode construction to corrode preferentially to the steel reinforcement;

providing adjacent the sacrificial anode construction a layer of a water transport medium;

covering at least part of the structure at least above the level of the sea water with a jacket which is impermeable to water and impermeable to oxygen wherein the jacket covers at least part of the anode and the layer of water transport medium adjacent the anode;

locating the layer of water transport medium such that a bottom part of the layer of water transport medium contacts the sea water and the layer of water transport medium extends to a position above the level of the sea water;

wherein the layer of water transport medium is different from the concrete.

2. The method according to claim 1 wherein the layer of water transport medium comprises fibers which are oriented to extend upwardly so as to cause wicking between the fibers.

3. The method according to claim 1 wherein the layer of water transport medium includes hollow fibers which are oriented to extend upwardly.

4. The method according to claim 1 wherein the sacrificial anode construction extends along the concrete structure to a top of the sacrificial anode construction and wherein the layer of water transport medium extends at least to the top of the sacrificial anode construction.

5. The method according to claim 1 wherein a top of the layer of water transport medium is exposed to air for evaporation of water from the top of the layer of water transport medium.

6. The method according to claim 1 wherein the layer of water transport medium includes a portion thereof exposed below a bottom end of the jacket for engaging the sea water.

7. The method according to claim 1 including casting a layer of concrete or grout within the jacket.

8. The method according to claim 1 wherein the jacket, sacrificial anode construction and water transport medium are applied directly to an outer surface of an existing concrete structure.

9. The method according to claim 1 wherein the sacrificial anode construction comprises an anode layer and wherein the layer of water transport medium comprises a layer in contact with or adjacent to the anode layer.

10. The method according to claim 9 wherein the layer of water transport medium covers both sides of the sacrificial anode construction.

11. The method according to claim 1 wherein there is provided at least one activator at or adjacent the sacrificial anode construction to promote corrosion of the anode.

12. The method according to claim 1 including casting alkaline concrete or alkaline grout with the sacrificial anode construction and the layer of water transport medium in place, the layer of water transport medium being located during the casting between the sacrificial anode construction and the alkaline grout or alkaline concrete as the alkaline grout or alkaline concrete is cast wherein the layer of water transport medium is non-alkaline and forms a barrier between the alkaline grout or alkaline concrete and the sacrificial anode construction so as to reduce the tendency of the alkaline grout or alkaline concrete to interfere with the corrosion of the sacrificial anode construction.

13. The method according to claim 1 wherein the jacket, the sacrificial anode construction and the layer of water transport medium comprise an assembled structure for common application to the concrete structure.

14. The method according to claim 1 wherein the layer of water transport medium provides a level of moisture transfer of the sea water to said position above the level of the sea water that is greater than that of the concrete.

15. A method of cathodic protection of a concrete structure comprising steel reinforcement in concrete located in sea water where at least a part of the concrete structure is located above a level of the sea water and part is below the level of the sea water, the method comprising:

providing a sacrificial anode construction which is more electro-negative than the steel reinforcement wherein the sacrificial anode construction is in ionic contact with at least a portion of the concrete;

the sacrificial anode construction including at least a part above the level of the sea water;

providing an electrical connection from the sacrificial anode construction to the steel reinforcement so that current flows through the electrical connection between the sacrificial anode construction and the steel reinforcement and an ionic current flows through the concrete or grout between the anode and the steel reinforcement to cause the sacrificial anode construction to corrode preferentially to the steel reinforcement;

providing adjacent the sacrificial anode construction a layer of a water transport medium;

casting alkaline concrete or alkaline grout with the sacrificial anode construction and the layer of water transport medium in place;

covering at least part of the structure at least above the level of the sea water with a jacket which is impermeable to water and impermeable to oxygen wherein the jacket covers at least part of the anode and the layer of water transport medium adjacent the anode;

the layer of water transport medium being located during the casting between the sacrificial anode construction and the alkaline grout or alkaline concrete as the alkaline grout or alkaline concrete is cast;

wherein the layer of water transport medium is non-alkaline and forms a barrier between the alkaline grout or alkaline concrete and the sacrificial anode construction so as to reduce the tendency of the alkaline grout or alkaline concrete to interfere with the corrosion of the sacrificial anode construction.

16. The method according to claim 15 wherein the layer of water transport medium comprises fibers which are oriented to extend upwardly so as to cause wicking between the fibers.

17. The method according to claim 15 wherein the layer of water transport medium includes hollow fibers which are oriented to extend upwardly.

18. The method according to claim 15 wherein the sacrificial anode construction extends along the concrete structure to a top of the sacrificial anode construction and wherein the layer of water transport medium extends at least to the top of the sacrificial anode construction.

19. The method according to claim 15 wherein a top of the layer of water transport medium is exposed to air for evaporation of water from the top of the layer of water transport medium.

20. The method according to claim 15 wherein the sacrificial anode construction and the layer of water transport medium are applied directly to an outer surface of an existing concrete structure.

21. The method according to claim 15 wherein the sacrificial anode construction comprises an anode layer and wherein the layer of water transport medium comprises a layer in contact with or adjacent to the anode layer.

22. The method according to claim 21 wherein the layer of water transport medium covers both sides of the sacrificial anode construction.

23. The method according to claim 15 wherein there is provided at least one activator at or adjacent the sacrificial anode construction to promote corrosion of the anode.

24. A method of cathodic protection of a concrete structure comprising steel reinforcement in concrete located in sea water where at least a part of the concrete structure is located above a level of the sea water and part is below the level of the sea water, the method comprising:

providing a sacrificial anode construction which is more electro-negative than the steel reinforcement wherein the sacrificial anode is in ionic contact with at least a portion of the concrete;

the sacrificial anode construction including at least a part above the level of the sea water;

providing an electrical connection from the sacrificial anode construction to the steel reinforcement in the concrete so that current flows through the electrical connection between the sacrificial anode construction and the steel reinforcement and an ionic current flows through the concrete between the anode and the steel reinforcement to cause the sacrificial anode construction to corrode preferentially to the steel reinforcement;

providing adjacent the sacrificial anode construction a layer of a water transport medium;

locating the layer of water transport medium such that a bottom part of the layer of water transport medium contacts the sea water and the layer of water transport medium extends to a position above the level of the sea water;

covering at least part of the structure at least above the level of the sea water with a jacket which is impermeable to water and impermeable to oxygen wherein the jacket covers at least part of the anode and the layer of water transport medium adjacent the anode;

wherein the layer of water transport medium comprises fibers which are oriented to extend upwardly so as to cause wicking between the fibers.

25. The method according to claim 24 wherein the sacrificial anode construction extends along the concrete structure to a top of the sacrificial anode construction and wherein the layer of water transport medium extends at least to the top of the sacrificial anode construction.

26. The method according to claim 24 wherein a top of the layer of water transport medium is exposed to air for evaporation of water from the top of the layer of water transport medium.

27. The method according to claim 24 wherein the sacrificial anode construction and the layer of water transport medium are applied directly to an outer surface of an existing concrete structure.

28. The method according to claim 24 wherein the sacrificial anode construction comprises an anode layer and wherein the layer of water transport medium comprises a layer in contact with or adjacent to the anode layer.

29. The method according to claim 24 wherein the layer of water transport medium covers both sides of the sacrificial anode construction.

30. The method according to claim 24 wherein there is provided at least one activator at or adjacent the sacrificial anode construction to promote corrosion of the anode.

31. The method according to claim 24 including casting alkaline concrete or alkaline grout with the sacrificial anode construction and the layer of water transport medium in place, the layer of water transport medium being located during the casting between the sacrificial anode construction and the alkaline grout or alkaline concrete as the alkaline grout or alkaline concrete is cast wherein the layer of water transport medium is non-alkaline and forms a barrier between the alkaline grout or alkaline concrete and the sacrificial anode construction so as to reduce the tendency of the alkaline grout or alkaline concrete to interfere with the corrosion of the sacrificial anode construction.

32. The method according to claim 24 wherein the sacrificial anode construction and the layer of water transport medium comprise an assembled structure for common application to the concrete structure.

* * * * *